US007041929B2

(12) United States Patent
Banghard et al.

(10) Patent No.: US 7,041,929 B2
(45) Date of Patent: May 9, 2006

(54) CONTACT ARRANGEMENT FOR A VACUUM SWITCH TUBE

(75) Inventors: Johannes-Gerhard Banghard, Friedrichsthal (DE); Klemens Fieberg, Berlin (DE); Michael Hahn, Berlin (DE); Werner Hartmann, Weisendorf (DE); Roman Renz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/451,253

(22) PCT Filed: Nov. 27, 2001

(86) PCT No.: PCT/DE01/04495

§ 371 (c)(1),
(2), (4) Date: Jun. 20, 2003

(87) PCT Pub. No.: WO02/50854

PCT Pub. Date: Jun. 27, 2002

(65) Prior Publication Data

US 2004/0026376 A1 Feb. 12, 2004

(30) Foreign Application Priority Data

Dec. 21, 2000 (DE) ..... 100 65 091

(51) Int. Cl.
*H01H 33/66* (2006.01)

(52) U.S. Cl. ..... 218/123; 218/128; 218/130
(58) Field of Classification Search ..... 218/118, 218/123, 124–133; 200/275, 279
See application file for complete search history.

(56) References Cited

U.S. PATENT DOCUMENTS

| | | | | |
|---|---|---|---|---|
| 3,158,719 | A | 11/1964 | Polinko, Jr. et al. | |
| 3,809,836 | A | 5/1974 | Crouch | |
| 3,869,589 | A | 3/1975 | Hundstad | |
| 4,695,689 | A | 9/1987 | Kurosawa et al. | |
| 5,210,385 | A | 5/1993 | Morel et al. | |
| 5,597,993 | A | 1/1997 | Yorita et al. | |
| 5,646,386 | A * | 7/1997 | Yorita et al. | 218/129 |
| 6,248,969 | B1 * | 6/2001 | Komuro et al. | 218/118 |

FOREIGN PATENT DOCUMENTS

| | | | |
|---|---|---|---|
| DE | 19624920 | A1 | 1/1998 |
| DE | 19707794 | A1 | 9/1998 |
| DE | 19802893 | A1 | 7/1999 |
| DE | 19910148 | A1 | 9/2000 |
| EP | 0532513 | B1 | 4/1991 |
| EP | 0905726 | A2 * | 3/1999 |
| WO | WO 00/03406 | | 1/2000 |

* cited by examiner

*Primary Examiner*—Lincoln Donovan
*Assistant Examiner*—M. Fishman
(74) *Attorney, Agent, or Firm*—Harness, Dickey & Pierce, P.L.C.

(57) ABSTRACT

The invention relates to a contact arrangement for a vacuum switch tube for low-voltage power switches. The aim of the invention is to reduce the contact force required to control short circuit currents. To this end, a twin-contact contact arrangement is used wherein every contact comprises a plurality of separate individual contacts having a defined spring rate. At least one of the contact bodies (4) is configured as a two-layer spiral contact with a lower layer consisting of a highly elastic material and an upper layer (7) consisting of a highly electroconductive material. A contact coat (9) consisting of a contact material is provided on the upper layer in the outer zone of every contact arm (10).

21 Claims, 1 Drawing Sheet

CONTACT ARRANGEMENT FOR A VACUUM SWITCH TUBE

This application is the national phase under 35 U.S.C. § 371 of PCT International Application No. PCT/DE01/04495 which has an International filing date of Nov. 27, 2001, which designated the United States of America and which claims priority on German Patent Application number DE 100 65 091.0 filed Dec. 21, 2000 the entire contents of which are hereby incorporated herein by reference.

FIELD OF THE INVENTION

The invention generally relates to the field of electrical components. Preferably, it is to be used for the structural design of vacuum interrupters. The contact arrangement preferably includes two coaxially arranged contacts with mutually facing contact surfaces, each contact being formed as a flat, multi-armed spiral contact and at least one contact arm being axially movable.

Contacts may generally have four arms, but may also be formed in a six-armed configuration (DE 196 24 920 A1). Contact arrangements for vacuum interrupters are known as so-called "vane electrodes" or "spiral contact" and often have an inner contact region, which is provided for switching operating currents, and an outer contact region, which concentrically surrounds the inner contact region, is provided for interrupting short-circuit currents and serves as a running surface for a rotating arc. In this case, the inner contact region projects over the outer contact region by a certain, not very large amount (U.S. Pat. No. 3,158,719 A, U.S. Pat. No. 3,809,836 A). In the case of other known embodiments of spiral contacts, the inner region of the contact surface is formed as a depression, so that the contact region provided for switching operating currents is identical to the contact region provided for interrupting short-circuit currents (EP 0 532 513 B1, DE 198 02 893 A1, DE 199 10 148 A1).

In order to be able to separate welded contact regions more easily from one another in the case of vacuum interrupters, it is known to give each contact a relatively large number of contact surfaces and to hold these elastically on a main contact body. A tubular main contact body with radially inwardly projecting support arms for the contact surfaces can be provided for this purpose (U.S. Pat. No. 3,869,589 A).

For air-breaking circuit breakers in the low-voltage range it is further known per se to divide the movable contact up into a plurality of contact fingers arranged parallel to one another, in order to reduce contact pressure force (U.S. Pat. No. 5,210,385 A).

In the case of vacuum interrupters for circuit breakers, in particular for circuit breakers in the low-voltage range (DE 199 10 148 A1), the high currents give rise to high forces on the contacts which tend to lift the contacts off one another. These current forces must be compensated by suitable measures to avoid lifting off of the contacts with the risk of them becoming welded to one another.

In the case of switches fitted with vacuum interrupters, this problem has been solved so far by using in addition to a permanently applied static contact pressure force an additional current loop, with the aid of which high dynamic magnetic field forces which act to strengthen the contact force are produced for a short time, i.e. particularly during the occurrence of short-circuit currents. This obviates the need for the entire contact pressure force, which is required only for a short time, to be applied mechanically. However, because of the relatively high costs of such current loops, the contact force to be permanently applied mechanically continues to be relatively large and can be several kN per switching pole, particularly in the case of high currents of more than 50 kA. This requires a switching device of a correspondingly high mechanical complexity.

SUMMARY OF THE INVENTION

An object of an embodiment of the invention is to form a contact arrangement in such a way that the mechanical contact point between the two contacts is distributed over a plurality of separate individual contacts with a defined spring constant, wherein the rotation of an arc is nevertheless possible.

To achieve an object, it is provided according to an embodiment of the invention, that each contact includes an at least two-layered contact body with a lower layer of a highly elastic material and an upper layer of a highly electroconductive material. The two layers are preferably adhesively/cohesively bonded to each other, and a contact piece is preferably arranged in the outer region of each contact arm.

In the case of such a configuration of the contact arrangement, the mechanical stability and electrical conductivity functions are separated from each other by a layer structure of the individual contacts. Spring properties are additionally integrated into the layer ensuring the mechanical stability and damped only insignificantly by the electrically conducting layer. The contact pieces in this case produce raised contact points, which lead to a resilient flexural load on the arms of the spiral contacts. In the case of such a configuration of the individual spiral contacts, the layer including a highly electroconductive, comparatively costly material can be kept as thin as the electrical requirements allow.

By backing this layer with a resilient layer, a premature fatigue rupture of the electrically conducting layer, including generally a brittle contact material, is avoided. Materials from the group of high-grade steels are preferably suitable for these purposes, while high-purity copper should be used for the electrically conducting layer. A thickness of approximately 3 to 5 mm is expediently chosen for the lower and upper layer, respectively, and a thickness of approximately 2 mm is expediently chosen for the support. The support expediently includes a material which contains copper and chromium, preferably of a tried-and-tested sintered copper-chromium material. If appropriate, this material may also be used for the electrically conducting layer. In this case, a copper layer may be arranged between the two layers to ensure the required electrical properties.

In order to distribute the mechanical contact point between the two spiral contacts over as many separate individual contacts as possible, it is recommendable to form the contacts as 5-armed, preferably 6-armed spiral contacts.

BRIEF DESCRIPTION OF THE DRAWINGS

Two exemplary embodiments of the novel contact arrangement are represented in FIGS. 1 to 3.

Of these.

DETAILED DESCRIPTION OF THE PREFERRED EMBODIMENTS

Figure 1:
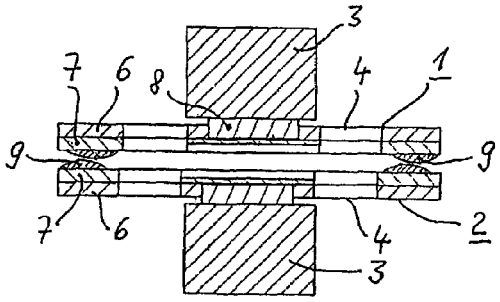
FIG. 1 shows a first contact arrangement with four-armed spiral contacts in cross section.
Figure 2:
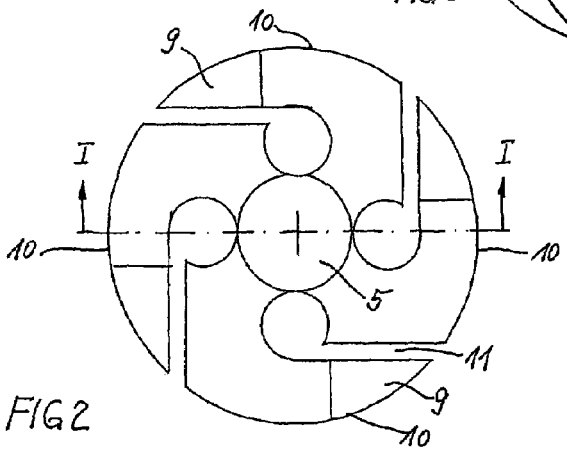
FIG. 2 shows a plan view of a contact of the arrangement according to FIG. 1

The two contacts 1 and 2 of the contact arrangement according to FIG. 1 are formed according to FIG. 2 as four-armed (10) spiral contacts and include a contact carrier 3 and the actual contact body 4.

In this case, each disk-shaped contact body 4 has a lower layer 6 and an upper layer 7; the layers 6 and 7 are adhesively/cohesively bonded to each other, in particular soldered. Contact pieces 9 are arranged on the upper layer 7. The contact body 4 is seated on a contact carrier 3, which is provided with a step 8 and is directly connected to the upper layer 7 through a bore in the lower layer 6. In this case, the contact carrier 3 includes high-purity copper, the lower layer 6 includes a high-grade steel, the upper layer 7 includes high-purity copper and the contact pieces 9 includes a sintered copper-chromium material.

According to FIG. 2, the contact arms 10 of the two spiral contacts 1 and 2 are formed by special slots 11, similar to the arrangement known from EP 0 532 513 B1. The slots are cut out from the disk-shaped contact body 4, which has a central depression 5, in order that the initiation of the arc in the region of the arms is ensured during switching. A contact piece 9 is respectively arranged at the ends of the contact arms 10, that is in the outer region of the contact arms.

Figure 3:
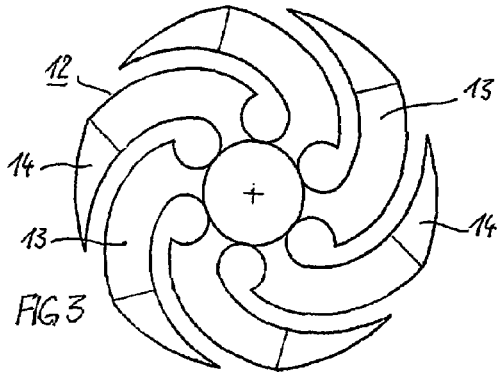
FIG. 3 shows a plan view of a contact of a second contact arrangement with six-armed spiral contacts.

FIG. 3 shows a contact body 12, which is formed in a six-armed configuration, a contact piece 14 being respectively arranged at the ends of the spirally running contact arms 13.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A contact arrangement for a vacuum interrupter, comprising:

two coaxially arranged contacts with mutually facing contact surfaces, wherein each contact is formed as a flat, spiral contact including a plurality of contact arms, at least one contact being axially movable, wherein at least one of the two contacts includes an at least two-layered contact body with a lower layer of a highly elastic material and an upper layer of a highly electroconductive material, the two layers being at least one of adhesively and cohesively bonded to each other, and wherein a raised contact point in the form of a contact piece is arranged at the ends of the contact arms, and wherein the lower layer consists of high-grade steel, the upper layer consists of high-purity copper and the contact piece includes a material which contains copper and chromium.

2. The contact arrangement as claimed in claim 1, wherein the thickness of the lower and upper layer is approximately 3 to 5 mm, respectively, and the thickness of the contact piece is approximately 2 mm.

3. A contact arrangement for a vacuum interrupter, comprising:

two coaxially arranged contacts with mutually facing contact surfaces, wherein each contact is formed as a flat, spiral contact including a plurality of contact arms, at least one contact being axially movable, wherein at least one of the two contacts includes an at least two-layered contact body with a lower layer of a highly elastic material and an upper layer of a highly electroconductive material, the two layers being at least one of adhesively and cohesively bonded to each other, and wherein a raised contact point in the form of a contact piece is arranged at the ends of the contact arms, and wherein the lower layer consists of high-grade steel and the upper layer includes a material which contains copper and chromium, and wherein a layer consisting of high-purity copper is arranged between these two layers.

4. The contact arrangement as claimed in claim 1, wherein each contact is formed as a six-armed spiral contact.

5. The contact arrangement as claimed in claim 1, wherein each contact is formed as a six-armed spiral contact.

6. The contact arrangement as claimed in claim 2, wherein each contact is formed as a six-armed spiral contact.

7. The contact arrangement as claimed in claim 3, wherein each contact is formed as a six-armed spiral contact.

8. A contact arrangement for a vacuum interrupter, comprising:

a plurality of coaxially arranged contacts including mutually facing contact surfaces, wherein at least one contact is formed as a multi-layered spiral contact including a lower layer of a relatively highly elastic material and an upper layer of a relatively highly electroconductive material, the two layers being bonded to each other, and wherein at least one raised contact point in the form of a contact piece is arranged at least one end of a contact arm of at least one of the contacts, and wherein the lower layer consists of high-grade steel, the upper layer consists of high-purity copper and the contact piece includes a material which contains copper and chromium.

9. The contact arrangement as claimed in claim 8, wherein the thickness of the lower and upper layer is approximately 3 to 5 mm, respectively, and the thickness of the contact piece is approximately 2 mm.

10. A contact arrangement for a vacuum interrupter, comprising:

a plurality of coaxially arranged contacts including mutually facing contact surfaces, wherein at least one contact is formed as a multi-layered spiral contact including a lower layer of a relatively highly elastic material and an upper layer of a relatively highly electroconductive material, the two layers being bonded to each other, and wherein at least one raised contact point in the form of a contact piece is arranged at least one end of a contact arm of at least one of the contacts, and wherein the lower layer consists of high-grade steel and the upper layer includes a material which contains copper and chromium, and a layer consisting of high-purity copper is arranged between these two layers.

11. The contact arrangement as claimed in claim 8, wherein each contact is formed as a six-armed spiral contact.

12. The contact arrangement as claimed in claim 8, wherein each contact is formed as a six-armed spiral contact.

13. The contact arrangement as claimed in claim 9, wherein each contact is formed as a six-armed spiral contact.

14. The contact arrangement as claimed in claim 10, wherein each contact is formed as a six-armed spiral contact.

15. The contact arrangement as claimed in claim 8, wherein the two layers being at least one of adhesively and cohesively bonded to each other.

16. A contact arrangement for a vacuum interrupter, comprising:

two coaxially arranged contacts with mutually facing contact surfaces, wherein each contact is formed as a flat, spiral contact including a plurality of contact arms, at least one contact being axially movable, wherein at least one of the two contacts includes an at least two-layered contact body with a lower layer of a highly elastic material and an upper layer of a highly electroconductive material, the two layers being at least one of adhesively and cohesively bonded to each other, and wherein a raised contact point in the form of a contact piece is arranged at the ends of the contact arms and wherein the contact piece is comprised of a different material than the upper layer.

17. A contact arrangement for a vacuum interrupter, comprising:

a plurality of coaxially arranged contacts including mutually facing contact surfaces, wherein at least one contact is formed as a multi-layered spiral contact including a lower layer of a relatively highly elastic material and an upper layer of a relatively highly electroconductive material, the two layers being bonded to each other, and wherein at least one raised contact point in the form of a contact piece is arranged at least one end of a contact arm of at least one of the contacts, and wherein the contact piece is comprised of a different material than the upper layer.

18. A contact arrangement for a vacuum interrupter, comprising:

two coaxially arranged contacts with mutually facing contact surfaces, wherein each contact is formed as a flat, spiral contact including a plurality of contact arms, at least one contact being axially movable, wherein at least one of the two contacts includes an at least two-layered contact body with a lower layer of a highly elastic material and an upper layer of a highly electroconductive material, the two layers being at least one of adhesively and cohesively bonded to each other, and wherein a raised contact point in the form of a separate contact piece is arranged at the ends of the contact arms, and wherein the lower layer includes high-grade steel, the upper layer includes high-purity copper and the contact piece includes a material which contains copper and chromium.

19. A contact arrangement for a vacuum interrupter, comprising:

two coaxially arranged contacts with mutually facing contact surfaces, wherein each contact is formed as a flat, spiral contact including a plurality of contact arms, at least one contact being axially movable, wherein at least one of the two contacts includes an at least two-layered contact body with a lower layer of a highly elastic material and an upper layer of a highly electroconductive material, the two layers being at least one of adhesively and cohesively bonded to each other, and wherein a raised contact point in the form of a separate contact piece is arranged at the ends of the contact arms, and wherein the lower layer includes high-grade steel and the upper layer includes a material which contains copper and chromium, and wherein a high-purity copper layer is arranged between these two layers.

20. A contact arrangement for a vacuum interrupter, comprising:

a plurality of coaxially arranged contacts including mutually facing contact surfaces, wherein at least one contact is formed as a multi-layered spiral contact including a lower layer of a relatively highly elastic material and an upper layer of a relatively highly electroconductive material, the two layers being bonded to each other, and wherein at least one raised contact point in the form of a separate contact piece is arranged at least one end of a contact arm of at least one of the contacts, and wherein the lower layer includes high-grade steel, the upper layer includes high-purity copper and the contact piece includes a material which contains copper and chromium.

21. A contact arrangement for a vacuum interrupter, comprising:

a plurality of coaxially arranged contacts including mutually facing contact surfaces, wherein at least one contact is formed as a multi-layered spiral contact including a lower layer of a relatively highly elastic material and an upper layer of a relatively highly electroconductive material, the two layers being bonded to each other, and wherein at least one raised contact point in the form of a separate contact piece is arranged at least one end of a contact arm of at least one of the contacts, and wherein the lower layer includes high-grade steel and the upper layer includes a material which contains copper and chromium, and a high-purity copper layer is arranged between these two layers.

* * * * *